United States Patent [19]

Panigoni

[11] 4,085,654

[45] Apr. 25, 1978

[54] GAS-OPERATED DEVICE FOR ACTIVATING THE RELOADING MECHANISM OF A GAS-OPERATED AUTOMATIC RIFLE

[75] Inventor: Giannantonio Panigoni, Brescia, Italy

[73] Assignee: Luigi Franchi S.p.A., Brescia, Italy

[21] Appl. No.: 715,580

[22] Filed: Aug. 18, 1976

[30] Foreign Application Priority Data

Sep. 29, 1975 Italy ..... 27752/75

[51] Int. Cl.[2] ..... F41D 5/04

[52] U.S. Cl. ..... 89/191 A

[58] Field of Search ..... 89/191 R, 191 A

[56] References Cited

U.S. PATENT DOCUMENTS

| | | | |
|---|---|---|---|
| 966,995 | 8/1910 | Brown | 89/191 R |
| 2,909,101 | 10/1959 | Hillberg | 89/191 A |
| 3,810,412 | 5/1974 | Zamacola | 89/191 A |

*Primary Examiner*—Stephen C. Bentley
*Attorney, Agent, or Firm*—Birch, Stewart, Kolasch & Birch

[57] ABSTRACT

A gas-operated device for activating the reloading mechanism of an automatic rifle comprising a cylinder housing and a movable piston, both mounted coaxially upon a cartridge store, the whole assembly being affixed below the rifle barrel. Gases from a cartridge exploded in the rifle breech are bled from the barrel through a duct into an annular chamber between the piston and a closed end of the cylinder to drive the piston and activate the reloading mechanism. Immediately prior to this bleeding, gases are bled through an additional duct into an interstice between the piston and the cylinder to act as a 'gaseous diaphragm' preventing leakage of the driving gases from the annular chamber, except when the pressure of these driving gases is excessively high.

4 Claims, 2 Drawing Figures

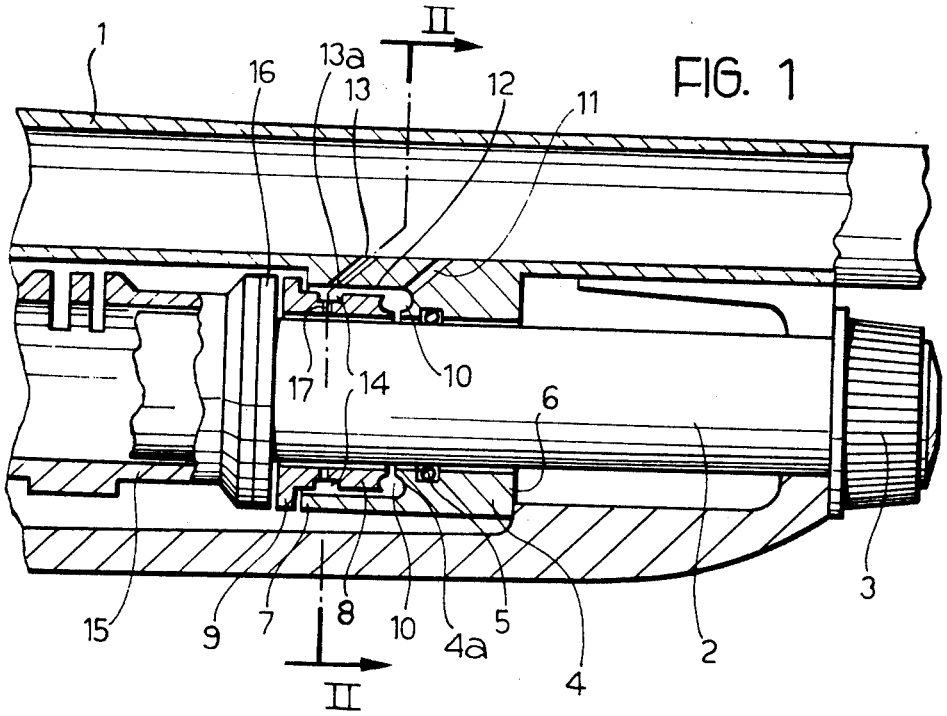
FIG. 1
FIG. 2
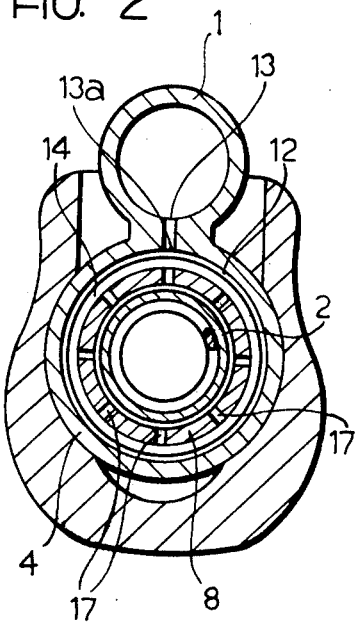

GAS-OPERATED DEVICE FOR ACTIVATING THE RELOADING MECHANISM OF A GAS-OPERATED AUTOMATIC RIFLE

BACKGROUND OF THE INVENTION

The present invention relates to a gas operated device for activating the reloading mechanism of an automatic rifle. More particularly, to such a device comprising a cylinder fixed to the rifle barrel and having a closed end and an open end, a piston slidable in the cylinder, and a chamber formed within the cylinder between the piston and the closed end, the chamber communicating with the interior of the rifle barrel through a gas duct.

In known gas-operated devices of the above type, firing gases generated by the explosion of a cartridge in the rifle breech are bled off from the rifle barrel, through the gas duct, into the chamber between the piston and the closed end of the cylinder. The pressure of these gases operates the piston which in turn activates the reloading mechanism. The pressure of the gases which operate the piston depends on the explosive power of the cartridge, since the cartridges available commercially for use in sporting rifles vary widely in their quantity of power, the pressures on the piston also vary widely. Therefore, in order for such gas-operated devices to operate under the varying conditions, and particularly with low pressures of the order of 90–100 atmosphere, the reloading mechanism is usually especially designed to operate at such low pressures and maximum use is made of the energy of the gases by providing precision-made mechanical seals between the cylinder and piston.

This method of achieving a seal between the cylinder and piston has a number of disadvantages. Firstly, the making and assembly of such mechanical seals having the required degree of precision is extremely difficult and laborious. Secondly, due to the precision and tightness of the seal, when a cartridge giving high pressure firing gases (180 – 200 atmospheres) is used, the mechanical stresses exerted on the reloading mechanism of the rifle are so high that they can result in breakage, deformation or jamming of the mechanism. If the mechanism is not broken, the high pressure firing gases would at least reduce the working life of the mechanism considerably.

In order to overcome the above disadvantages, compensating and/or regulating devices, which absorb the excess kinetic energy of the piston, or selectively operable mechanical compensators which compensate for the different thrusts upon the piston, or pressure relief valves which discharge the excess pressure of the diverted gases, may be incorporated in such gas-operated rifles. The use of any of these compensating and/or regulating devices, complicates the functioning of the rifle and may make the mechanism even more prone to jamming, however, these devices do not ensure the desired safe functioning of the rifle however accurate the assembly and adjustment of the devices.

Therefore, an object of the present invention is to provide a gas-operated device for activating the reloading mechanism of an automatic rifle which may be used with a wide range of commercially available cartridges but which does not incorporate mechanical seals in the cylinder-piston coupling, nor involve the use of mechanical compensating or regulating devices.

According to the present invention there is provided a gas-operated device for activating the reloading mechanism of an automatic rifle, comprising a cylinder fixed to the rifle barrel, and having an open end and a closed end, a piston slidable in the cylinder, and a chamber formed within the cylinder between the piston and the closed end, the chamber communicating with the interior of the rifle barrel through a first gas duct, characterised in that there is provided an interstice coaxial with and between the piston and the cylinder, the interstice communicating with the said chamber and opening through at least one second gas duct into the interior of the rifle barrel at a position closer to the breech end of the barrel than the opening of the first gas duct into the rifle barrel.

Preferably, the piston has an annular groove in its surface such that in the fully inserted position of the piston in the cylinder, the or vents vent of the second gas duct into the interstice is opposite the groove.

When a cartridge is fired from a rifle equipped with a device according to the present invention portions of the firing gas are bled successively into the interstice between the cylinder and the piston and into the chamber between the piston and the closed end of the cylinder. Within the interstice and the chamber the gases expand, thereby lowering the pressure, to values dependent upon the respective volumes of the interstice and the chamber. The gases beld into the chamber attempt to escape through the interstice, but escape is prevented by the counterpressure of the gases bled previously into the interstice. Thus a 'gaseous diaphragm' is created in the interstice which acts as a seal against the release of the gases from the chamber and results in almost total exploitation of the energy of these gases for moving the piston and operating the reloading mechanism of the rifle.

The position of the gaseous diaphragm in the interstice varies according to the value of the firing-gas pressure at the openings to the gas ducts in the rifle barrel, the relative dimensions of the gas ducts, the volume of the interstice between piston and cylinder, the volume of the chamber formed between the piston and the closed end of the said cylinder, and according to the ratio of these volumes. In practice, the dimensions of the ducts, interstice and chamber being predetermined, therefore, the position of the 'gaseous diaphragm' in the interstice depends exclusively upon the pressure of the firing gases. When this pressure is low (90–100 atmospheres), the 'gaseous diaphragm' is formed very close to the chamber but as the pressure of the firing gases increase the position of the said diaphragm moves towards the open end of the cylinder. When the pressure of the firing gases is very high (180–200 atmospheres) the counterpressure of the gases diverted directly into the interstice, while still impeding the escape of the gases diverted into the chamber, is no longer able to act as a gaseous sealing diaphragm. The gases can therefore escape, to a limited degree, through the interstice, so that the pressure on the piston is reduced, with consequent reduction of the force exerted by the piston on the reloading mechanism of the rifle.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

FIG. 1 is a longitudinal section of a device according to the present invention affixed to the barrel of an automatic sporting rifle;

FIG. 2 is a transverse section taken along the line II—II of FIG. 1.

DETAILED DESCRIPTION OF THE INVENTION

Referring to the drawings, a barrel of a gas-operated automatic rifle is shown at 1 and a cartridge store which extends parallel to and below the barrel 1, in normal use of the rifle, is shown at 2.

A cylinder 4, affixed to the barrel 1 by known means (not shown), is assembled coaxially upon the store 2. The cylinder 4 is open at one end 7 towards the rifle breech (not shown), but the clearance between the cylinder 4 and the cartridge store 2 at the opposite end of the cylinder 4, nearer the muzzle of the rifle, is sealed by a sealing ring 5, effectively closing this end of the cylinder 4.

Also assembled coaxially upon the store 2 and within the cylinder 4 is a piston 8, one end of which extends through the open end 7 of the cylinder 4 and is provided with a flange 9. Between the opposite end of the piston 8 and an internal shoulder 4*a* of the cylinder 4 is an annular chamber 10 which communicates with the interior of the barrel 1 through a gas duct 11 in a common wall of the barrel 1 and the cylinder 4.

Extending from the annular chamber 10, between the opposing cylindrical walls of the piston 8 and the cylinder 4, is an interstice 12 which communicates with the interior of the barrel 1 through a further gas duct 13 in the common wall of the barrel 1 and the cylinder 4. The gas duct 13 opens into the interstice 12 through a vent 13*a* and opens into the barrel 1 at a position closer to the rifle breech than the duct 11. An annular, rectangular-section groove 14 is provided in the external surface of the piston 8 immediately opposite the vent 13*a* of the duct 13, in the fully inserted position of the piston 8 in the cylinder 4, shown in FIG. 1. The piston 8 is further provided with a number of radial through-holes 17 through which the clearance space between the piston 8 and the cartridge store 2 communicates with the interstice 12.

A movable sleeve 15 having an annular head 16 which cooperates with the flange 9 of the piston 8 is also assembled coaxially upon the store 2. The sleeve 16 is connected by known means (not shown) to the reloading mechanism (not shown) of the rifle and is urged towards the cylinder and piston assembly by resilient means (not shown).

When a cartridge is exploded in the rifle breech, the cartridge (not shown) is thrust along the barrel 1 by the firing gases and first clears the entrance to the duct 13, allowing a portion of the firing gases to escape through the duct 13 into the interstice 12 and the annular groove 14. Immediately thereafter the cartridge clears the entrance to the duct 11, and a further portion of the firing gases escapes into the chamber 10. The expansion of the gases in the chamber 10 forces the piston 8 towards the breech, the piston 8 encountering and pushing the sleeve 15 which operates the reloading mechanism of the rifle.

As the portion of the gases bled into the chamber 10 expand the gases attempt to escape through the interstice 12 and are prevented by the counterpressure in the interstice 12 due to the gases previously bled from the barrel 1 through the duct 13. This cunterpressure effectively creates a 'gaseous diaphragm' which constitutes a seal between the opposing surfaces of the piston 8 and cylinder 4.

The value of the counter-pressure and hence the position of the said gaseous diaphragm in the interstice 12, depends on numerous factors, among which are the pressure of the firing gases at the openings to the ducts 11 and 13 in the barrel 1, the dimensions of the ducts 11 and 13, the volume of the space formed by the interstice 12 and the annular groove 14 and the volume of the chamber 10. Since, in the device according to the invention, these dimensions and volumes are predetermined, the value of the counter-pressure and hence the position of the gaseous diaphragm in the interstice 12 depends on the pressure of the firing gases at the openings to the ducts 11 and 13 in the barrel 1. When this pressure is low (90–100 atm.), the pressure of the gas diverted into the chamber 10 and the counter-pressure of the gas in the interstice 12, will be such that the said gaseous diaphragm will be positioned in the interstice 12 close to the chamber 10. When the pressure of the firing gases at the openings to the ducts 11 and 13 in the barrel 1 is increased, the difference between the pressures of the gases diverted into the chamber 10 and those diverted into the interstice 12 and the annular groove 14 is also increased, so that the position of the 'gaseous diaphragm' is moved towards the open end 7 of the cylinder 4. When the pressure of the firing gases at the openings to the ducts 11 and 13 in the barrel 1 is very high (180–200 atm.), the difference between the said pressures of the diverted gases is so negligible that no further 'gaseous diaphragm' is formed in the interstice 12, thus a portion of the gases diverted into the chamber 10 through the duct 11 can overcome the counter-pressure in the interstice 12, and can escape through the open end 7 of the cylinder 4. This escape of gas reduces the thrust of the gases in the chamber 10 on the piston 8, and hence reduces the mechanical stresses which result from the total exploitation of the energy of these gases as they are exerted on the reloading mechanism of the rifle. Thus a gas-tight seal is achieved in the cylinder-piston connection without the aid of washers or like mechanical seals. Also a certain degree of automatic adjustment of the stresses exerted upon the reloading mechanisms is achieved.

In addition, a similar gas-tight seal is achieved in the clearance between the piston 8 and the cartridge store 2 by the presence in this clearance of a pressure generated by the gases diverted through the radial holes 17.

The construction dimensions of a typical embodiment of a device according to the present invention are given below.

A cartridge of restricted power, but generating a pressure of the firing gases at the openings to the ducts 11 and 13 of not less than 90 atmospheres, was used in a 12 caliber gas-operated automatic sporting rifle including two gas ducts 11 located at a distance of 250 mm from the breech of the rifle. It was found that the gas-operated device according to the invention functioned as described above with the following dimensions:

ducts 11 — diameter 2.5 mm duct 13 — diameter 2.5 mm and positioned at a distance of about 15 mm from the ducts 11;

interstice 12 — formed by a clearance of 0.15 mm between the piston 8 and the cylinder 4;

chamber 10 — volume of 2000 $mm^3$;

annular groove 14 — volume of 200 $mm^3$.

Such variations are not to be regarded as a departure from the spirit and scope of the invention, and all such modifications as would be obvious to one skilled in the art are intended to be included within the scope of the following claims.

What is claimed is:

1. In an automatic rifle, a gas-operated device for activating the reloading mechanism of the rifle, comprising:

a cylinder fixed to the rifle barrel, said cylinder having an open end and a closed end;

a piston slidable in said cylinder;

a chamber formed within said cylinder between said piston and said closed end;

means defining a first gas duct communicating with said chamber, and means defining a first opening of said first gas duct into said rifle barrel;

wherein the improvement comprises:

(a) said cylinder and said piston define between them an interstice, coaxial with said cylinder and said piston and communicating with said chamber;

(b) means defining at least one second gas duct communicating with said interstice;

(c) means defining at least one second opening of said at least one second gas duct into said rifle barrel, said at least one second opening being at a position closer to the breech end of said rifle barrel than said first opening of said first gas duct; and (d) means defining an annular groove in the surface of said piston and means defining at least one vent of said at least one second gas duct into said interstice, said annular groove being opposite said at least one vent in the fully inserted position of said piston in said cylinder.

2. The device defined in claim 1 wherein, there is provided a cartridge store extending parallel to said rifle barrel, said piston and said cylinder being assembled coaxially upon said cartridge store, said piston being slidable upon said store and said piston and said store defining therebetween a predetermined clearance space.

3. In an automatic rifle, a gas-operated device for activating the reloading mechanism of the rifle, comprising:

a cylinder fixed to the rifle barrel, said cylinder having an open end and a closed end;

a piston slidable in said cylinder;

a chamber formed within said cylinder between said piston and said closed end;

means defining a first gas duct communicating with said chamber, and means defining a first opening of said first gas duct into said rifle barrel;

wherein the improvement comprises:

(a) said cylinder and said piston define between them an interstice, coaxial with said cylinder and said piston and communicating with said chamber;

(b) means defining at least one second gas duct communicating with said interstice;

(c) means defining at least one second opening of said at least one second gas duct into said rifle barrel, said at least one second opening being at a position closer to the breech end of said rifle barrel than said first opening of said first gas duct; and (d) means defining a number of radial through-holes in said piston, said through-holes communicating with said clearance space and with said interstice.

4. The device defined in claim 3 wherein, there is provided a cartridge store extending parallel to said rifle barrel, said piston and said cylinder being assembled coaxially upon said cartridge store, said piston being slidable upon said store and said piston and said store defining therebetween a predetermined clearance space.

* * * * *